US010553949B2

(12) United States Patent
Cho et al.

(10) Patent No.: US 10,553,949 B2
(45) Date of Patent: Feb. 4, 2020

(54) WIRELESS COMMUNICATION ANTENNA INCLUDING MAGNETIC BODY

(71) Applicant: WITS Co., Ltd., Yongin-si, Gyeonggi-do (KR)

(72) Inventors: Sung Nam Cho, Suwon-si (KR); Jung Young Cho, Suwon-si (KR); Jae Hyuk Jang, Suwon-si (KR); Chang Hak Choi, Suwon-si (KR); Jeong Ki Ryoo, Suwon-si (KR); Soon Kwang Kwon, Suwon-si (KR)

(73) Assignee: WITS Co., Ltd., Gyeonggi-do (KR)

( * ) Notice: Subject to any disclaimer, the term of this patent is extended or adjusted under 35 U.S.C. 154(b) by 385 days.

(21) Appl. No.: 15/369,015

(22) Filed: Dec. 5, 2016

(65) Prior Publication Data

US 2017/0365915 A1 Dec. 21, 2017

(30) Foreign Application Priority Data

Jun. 21, 2016 (KR) ..... 10-2016-0077538

(51) Int. Cl.

| | |
|---|---|
| ***H01Q 7/06*** | (2006.01) |
| ***H01Q 1/27*** | (2006.01) |
| ***H01Q 7/00*** | (2006.01) |

(52) U.S. Cl.

CPC ..... *H01Q 7/06* (2013.01); *H01Q 1/273* (2013.01); *H01Q 7/00* (2013.01)

(58) Field of Classification Search

CPC H01Q 1/273; H01Q 7/00; H01Q 7/06; H01Q 7/08; H01F 3/10; H01F 2003/106

See application file for complete search history.

(56) References Cited

U.S. PATENT DOCUMENTS

| | | | | |
|---|---|---|---|---|
| 8,345,514 | B2 * | 1/2013 | Sumida | H01Q 1/273 368/293 |
| 2007/0040643 | A1 * | 2/2007 | Inoue | H01F 17/045 336/213 |
| 2011/0124299 | A1 | 5/2011 | Koujima et al. | |
| 2012/0091210 | A1 * | 4/2012 | Koujima | G06K 19/07749 235/492 |
| 2015/0325918 | A1 | 11/2015 | Ito | |

FOREIGN PATENT DOCUMENTS

| | | | |
|---|---|---|---|
| CN | 102365787 | A | 2/2012 |
| CN | 205039258 | U | 2/2016 |
| JP | 2005-184094 | A | 7/2005 |

(Continued)

OTHER PUBLICATIONS

Korean Office Action dated May 22, 2017, in corresponding Korean Application No. 10-2016-0077538 (8 pages in English, 7 pages in Korean).

(Continued)

*Primary Examiner* — Robert Karacsony

(74) *Attorney, Agent, or Firm* — Harness, Dickey & Pierce, P.L.C.

(57) ABSTRACT

A wireless communication antenna includes: a magnetic body including a plurality of bar-shaped unit ribbons arranged in columns, wherein the unit ribbons have shape anisotropy and a radiation direction on a side of the wireless communication antenna; and a solenoid coil including conductive patterns disposed around the magnetic body.

11 Claims, 14 Drawing Sheets

(56) References Cited

FOREIGN PATENT DOCUMENTS

| | | | |
|---|---|---|---|
| JP | 2007-251819 | A | 9/2007 |
| JP | 2011-14919 | A | 1/2011 |
| KR | 10-2011-0005249 | A | 1/2011 |
| KR | 10-2011-0134430 | A | 12/2011 |
| KR | 10-2015-0145719 | A | 12/2015 |

OTHER PUBLICATIONS

Chinese Office Action dated Mar. 28, 2019 in counterpart Chinese Patent Application No. 201611205079.7 (21 pages in English and 11 pages in Chinese).

* cited by examiner

I - I'

WIRELESS COMMUNICATION ANTENNA INCLUDING MAGNETIC BODY

CROSS-REFERENCE TO RELATED APPLICATIONS

This application claims benefit under 35 USC 119(a) of priority to Korean Patent Application No. 10-2016-0077538 filed on Jun. 21, 2016 in the Korean Intellectual Property Office, the entire disclosure of which is incorporated herein by reference for all purposes.

BACKGROUND

1. Field

The following description relates to a wireless communication antenna including a magnetic body.

2. Description of Related Art

Wireless communications are commonly applied to various applications. In particular, a wireless communication antenna in a form of a coil, in connection with electronic approval of certain transactions, may be applied to various devices.

In a mobile device, a wireless communication antenna having a form of a spiral coil attached to a cover of the mobile device has recently been adopted. In addition, as wearable wireless devices have come into widespread use, demand for a wireless communication antenna suitable for wearable devices, as well as mobile devices, has increased.

Wireless communication antennas adopted in wearable devices should provide reliable data transmissions and satisfy a requirement of a radiation direction and a radiation range for user convenience. In addition, due to miniaturization demands, wireless communication antennas mounted in wearable devices should have a relatively small size and should be able to be mass produced.

A material and a structure of a magnetic body serving as a core of the wireless communication antenna are to be considered in order to provide the characteristics discussed above.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a wireless communication antenna includes: a magnetic body including a plurality of bar-shaped unit ribbons arranged in columns, wherein the unit ribbons have shape anisotropy and a radiation direction on a side of the wireless communication antenna; and a solenoid coil including conductive patterns disposed around the magnetic body.

A length direction of the unit ribbons may be parallel to an axis direction of the solenoid coil part.

The plurality of unit ribbons may be further arranged in stacked magnetic layers.

The unit ribbons may be arranged such that a boundary between unit ribbons, among the plurality of unit ribbons, of one magnetic layer, among the stacked magnetic layers, does not overlap a boundary between unit ribbons, among the plurality of unit ribbons of a magnetic layer, among the stacked magnetic layers, adjacent to the one magnetic layer.

The magnetic body may further include a wall separating the columns.

The wall may include a continuous film surrounding a side surface of each of the columns and one of a top surface and a bottom surface of each of the columns.

The wireless communication antenna of claim 6, wherein the wall comprises a material having magnetic properties.

The plurality of unit ribbons may include one of a nanocrystal alloy, an amorphous crystal alloy, and permalloy.

Each unit ribbon among the plurality of unit ribbons may have a thickness of 10 μm to 200 μm.

Each unit ribbon among the plurality of unit ribbons may have a width of 40 mm or less.

The magnetic body may have a shape that is outwardly convex in an axis direction of the solenoid coil.

In another general aspect, a wireless communication antenna includes: a magnetic body including a plurality of metal ribbons arranged in columns; a first substrate disposed on a top surface of the magnetic body and including first conductive patterns; a second substrate disposed on a bottom surface of the magnetic body and including second conductive patterns; and conductive vias connecting the first conductive patterns to the second conductive patterns.

The plurality of metal ribbons may be further arranged in stacked magnetic layers.

The plurality of metal ribbons may be arranged such that a boundary between metal ribbons, among the plurality of metal ribbons, of one magnetic layer, among the stacked magnetic layers, does not overlap a boundary between metal ribbons, among the plurality of metal ribbons, of a magnetic layer, among the stacked magnetic layers, adjacent to the one magnetic layer.

The magnetic body may further include a wall separating the columns.

The wall may include a continuous film surrounding a side surface and one of a top surface and a bottom surface of each of the columns.

The wall may include a material having magnetic properties.

The plurality of metal ribbons may include of one of a nanocrystal alloy, an amorphous crystal alloy, and permalloy.

The plurality of metal ribbons may have an aspect ratio of 1:6 to 1:9.

In another general aspect, a wearable device includes: a body; and a wireless communication antenna mounted to the body, wherein the wireless communication antenna includes a magnetic body including bar-shaped, shape-anisotropic ribbons arranged in columns and a radiation direction on a side of the wearable device; and a solenoid coil including conductive patterns disposed around the magnetic body.

The wireless communication antenna may further include substrates. The magnetic body may be disposed between the substrates. The conductive patterns may be disposed on the substrates.

The substrates may include a first substrate disposed on a first surface of the magnetic body, and a second substrate disposed on a second surface of the magnetic body. The conductive patterns may include first conductive patterns disposed on the first substrate, and second conductive patterns disposed on the second substrate.

The wearable device may further include conductive vias connecting the first conductive patterns to the second conductive patterns.

In another general aspect, a wireless communication antenna includes: a magnetic body including metal ribbons arranged in layers; a first substrate disposed on a first surface of the magnetic body; a second substrate disposed on a second surface of the magnetic body; first conductive patterns disposed on the first substrate; second conductive patterns disposed on the second substrate; and conductive vias disposed in the first substrate and the second substrate in a region around the magnetic body, and connecting the first conductive patterns to the second conductive patterns.

The magnetic body may further include a wall separating the metal ribbons.

The wall may include a magnetic material.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
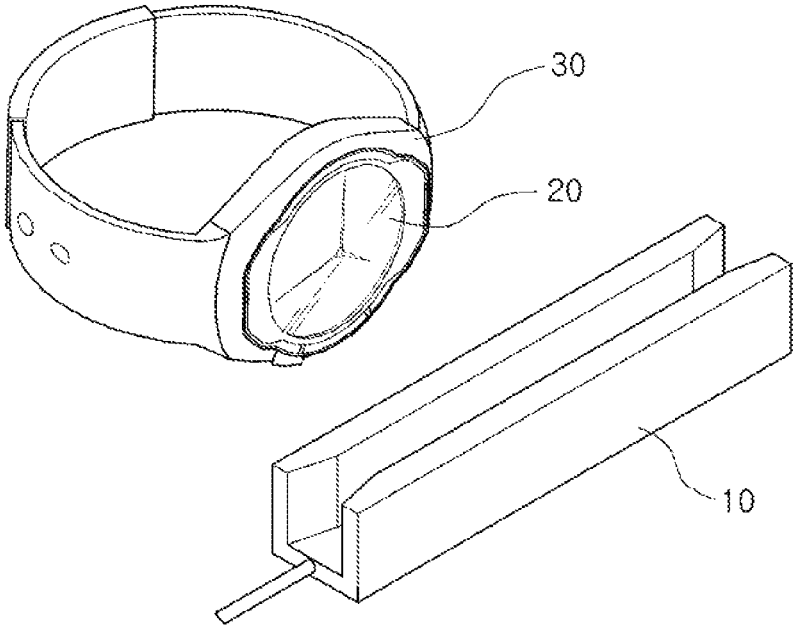
FIG. 1 is a perspective view illustrating an example in which a wearable device performs wireless communications.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a perspective view illustrating an example in which a wearable device 30 performs wireless communications. Referring to FIG. 1, the wearable device 30 is an electronic device which may be worn on a human body such as on an arm or the head, or may be fixed to a specific structure by a strap 130. Hereinafter, the wearable device 30 is described as having a form of a watch, but the disclosure is not limited to such an example.

A wireless communication antenna 20 is applied to the wearable device 30. The wireless communication antenna 20 forms a magnetic field under control of the wearable device 30. The wireless communication antenna 20 is operated as a transmitting coil, and is magnetically coupled to a wireless signal receiver 10 including a receiving coil to thereby wirelessly transmit data.

In the example illustrated in FIG. 1, the wireless signal receiver 10 is a magnetic card reader. However, various other wireless signal receivers may be used in addition to the magnetic card reader 10.

The wireless communication antenna 20 may form a widespread magnetic field, and may be magnetically coupled to the magnetic card reader 10 even if a position or an angle of the receiving coil of the magnetic card reader 10 is changed.

For example, the wireless communication antenna 20 transmits data, such as card number data for a magnetic card 215 (see FIG. 2), intended to be transmitted to the magnetic card reader 10, by changing a direction of the magnetic field. In other words, the magnetic card reader 10 generates the card number data using a change in a voltage across the receiving coil caused by the change in a direction of the magnetic field formed by the wireless communication antenna 20. For example, the magnetic card 215 illustrated in FIG. 2 is a credit card, debit card or membership card.

Hereinafter, a magnetic coupling between the wireless communication antenna 20 and the magnetic card reader 10, and an operation of the magnetic card reader will be described in more detail with reference to FIGS. 2 and 3.

Figure 2:
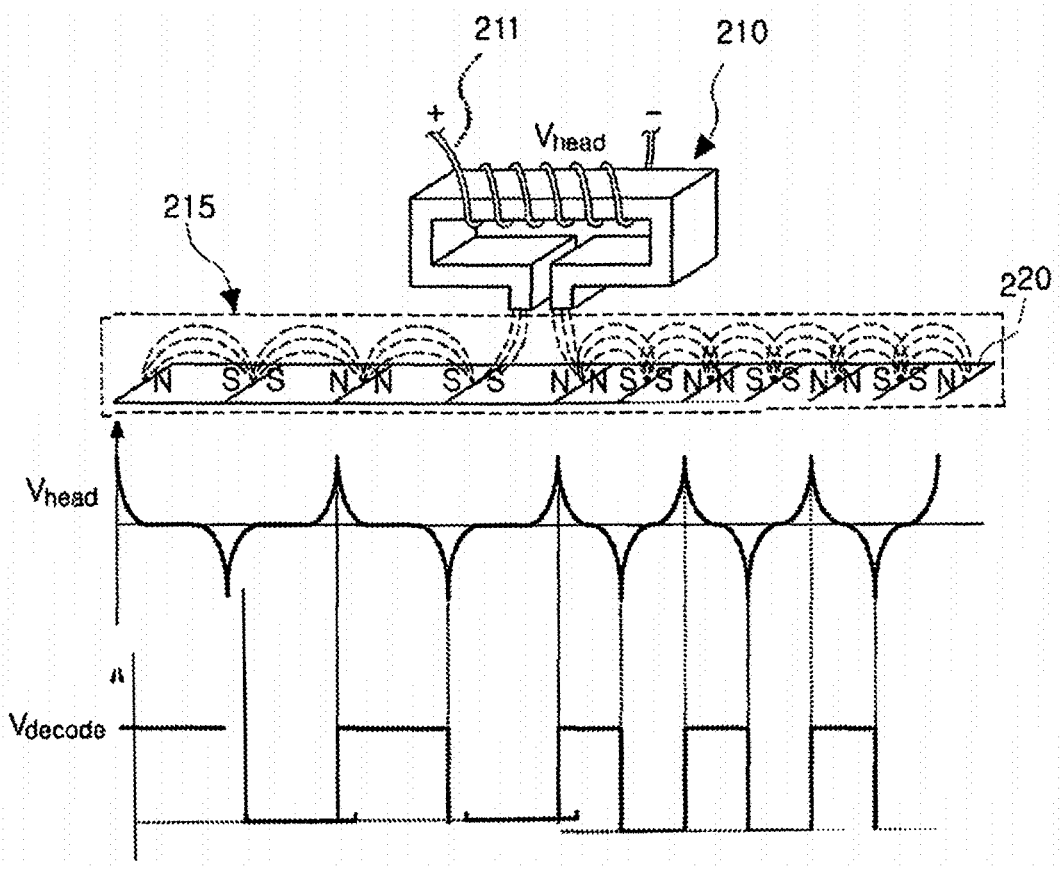
FIG. 2 illustrates voltage across a magnetic head adjacent to a magnetic card, according to an example.

FIG. 2 illustrates an example of voltage across a magnetic head 210 adjacent to the magnetic card 215. Referring to FIG. 2, the magnetic card reader 10 (FIG. 1) includes the magnetic head 210 and an analog-digital converter (not shown). The magnetic head 210 generates a voltage by subtending magnetic flux. That is, the magnetic head 210 includes a receiving coil 211, and detects a voltage $V_{head}$ across the receiving coil 211 generated by the magnetic field.

When the receiving coil 211 experiences a change in the magnetic field, a voltage $V_{head}$ across the receiving coil 211 is generated by the magnetic flux. The generated voltage $V_{head}$ across the receiving coil 211 is provided to the analog-digital converter, and the analog-digital converter generates a decoded signal $V_{decode}$ from the voltage across the receiving coil 211. The decoded signal $V_{decode}$ is a digital voltage signal, and card information data is generated from the decoded signal $V_{decode}$.

The magnetic card 215 includes a magnetized magnetic stripe 220. As the magnetic head 210 is moved over the magnetic stripe 220, the voltage $V_{head}$ across the receiving coil 211 of the magnetic head 210 is generated by the magnetic flux. The voltage $V_{head}$ across the receiving coil 211 has a peak voltage depending on polarities of the magnetic stripe 220. For example, the voltage $V_{head}$ across the receiving coil 211 has the peak voltage in a case in which the same polarities are adjacent to each other-S to S, or N to N.

In addition, the analog-digital converter generates the decoded signal $V_{decode}$ from the voltage $V_{head}$ across the receiving coil 211. For example, the analog-digital converter generates an edge when the peak voltage is detected to generate the decoded signal $V_{decode}$.

Digital data is decoded from the decoded signal $V_{decode}$. For example, a '1' or '0' is decoded depending on a length of a period of the decoded signal $V_{decode}$. It can be seen from the example illustrated in FIG. 2 that a length of each of a first period and a second period of the decoded signal $V_{decode}$ is equal to two lengths of a third period of the decoded signal $V_{decode}$. Therefore, the first period and the second period of the decoded signal $V_{decode}$ may be decoded to '1', and a third period to a fifth period of the decoded signal $V_{decode}$ may be decoded to '0'. Such a decoding method is illustrative, and it will be apparent to one of skill in the art that various decoding technologies may be applied.

FIG. 2 illustrates an example in which the magnetic card reader 10 performs decoding from the magnetized magnetic stripe 220. The magnetic head 210 is capable of generating the voltage across the receiving coil 211 from the magnetic field generated by the wireless communication antenna 20 and the magnetized magnetic stripe 220. That is, the magnetic head 210 of the magnetic card reader is magnetically coupled to the transmitting coil of the wireless communication antenna 20 to receive data, for example, card number data.

Figure 3:
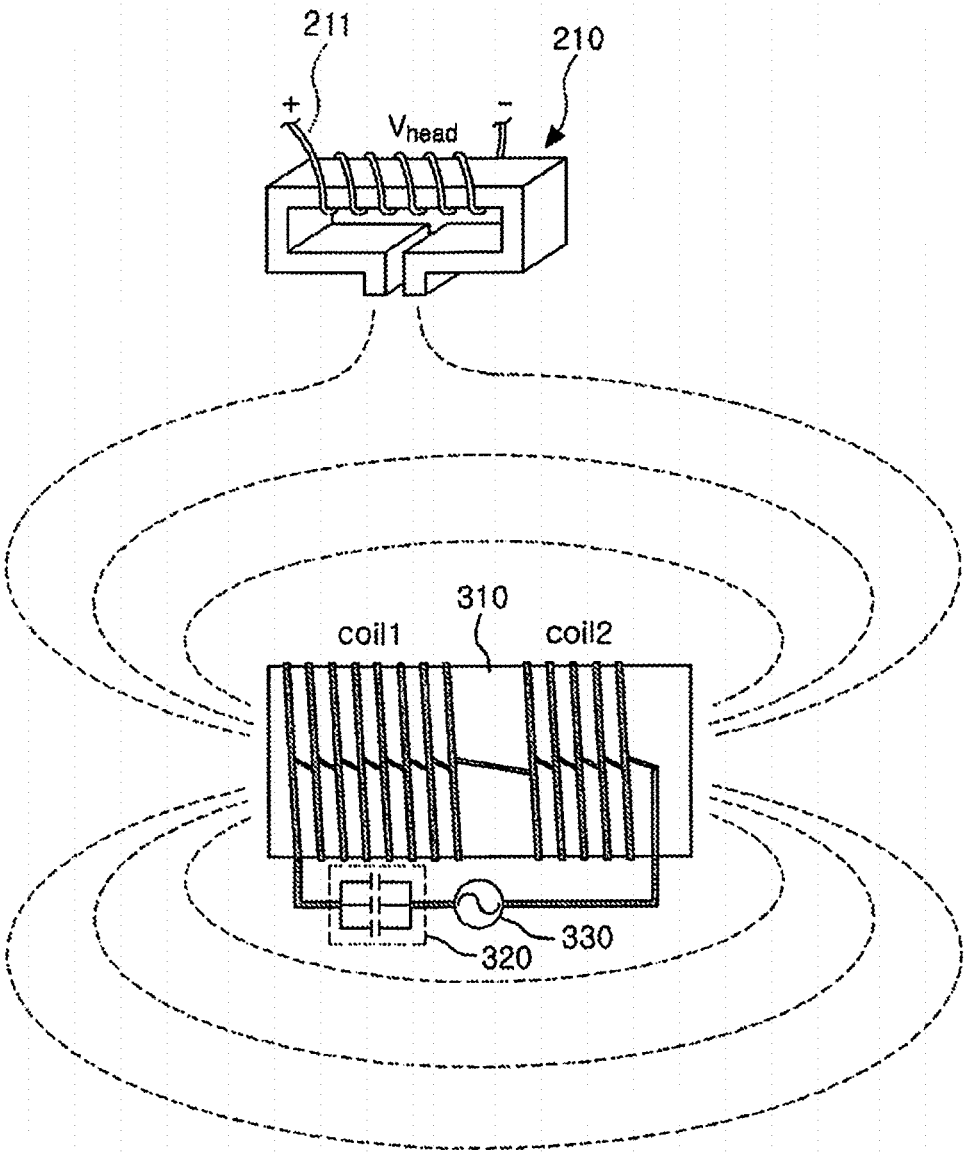
FIG. 3 illustrates an example in which a magnetic head of a magnetic card reader is magnetically coupled to a wireless communication antenna.

FIG. 3 illustrates an example in which the magnetic head 210 of the magnetic card reader 10 is magnetically coupled to a wireless communication antenna 310. Referring to FIG. 3, the wireless communication antenna 310 is provided with a driving signal from a driving signal generator 330, included, for example, in a wearable device, to form a magnetic field. The magnetic head 210 is magnetically coupled to a magnetic field formed by transmitting coils coil1 and coil2 to receive data.

In addition, the wireless communication antenna 310 includes a filter circuit 320 that operates to remove noise from the driving signal or to convert the driving signal to a form suitable for driving the wireless communication antenna 310.

Figure 4:
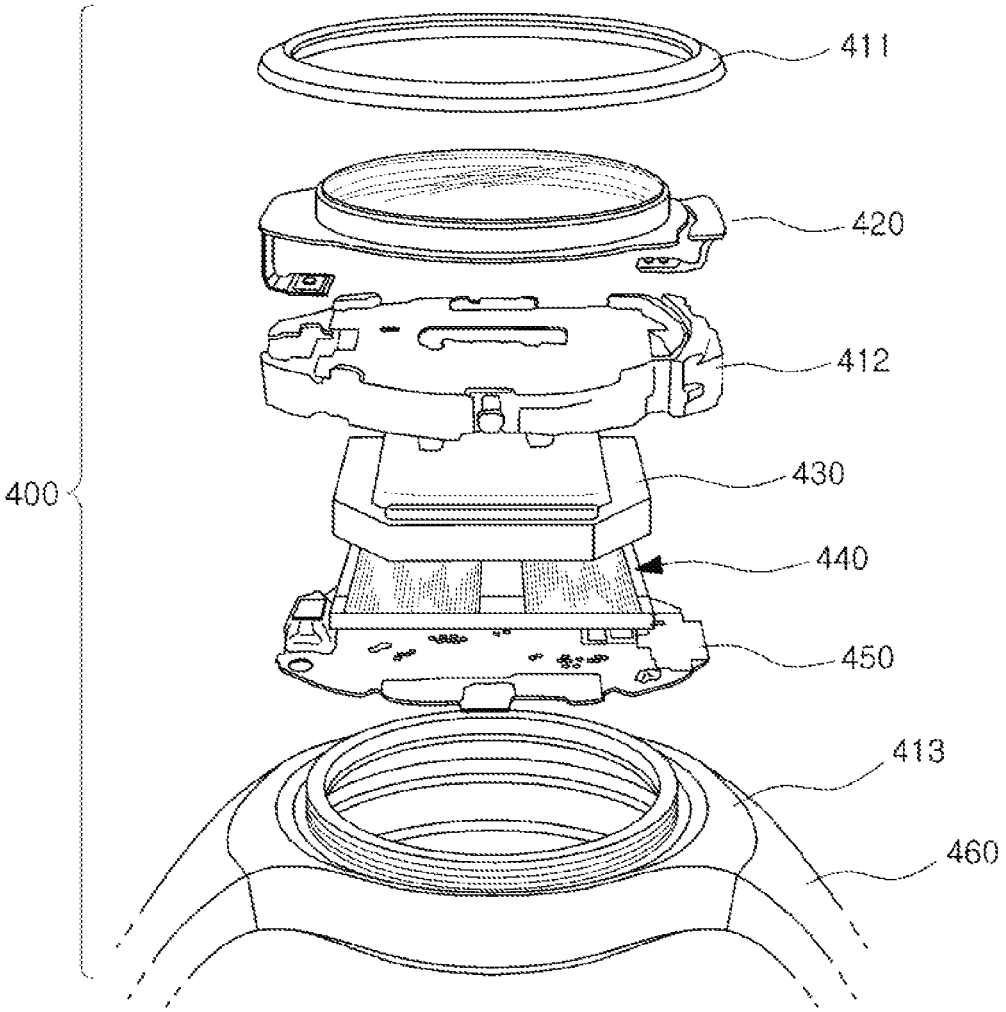
FIG. 4 is an exploded perspective view of a wearable device, according to an example.

FIG. 4 is an exploded perspective view of a wearable device 400, according to another example. Referring to FIG. 4, the wearable device 400 includes a case 410, a display 420, a battery 430, a wireless communication antenna 440, and a main board 450. In addition, as an example, the wearable device 400 includes a strap 460 by which the wearable device may be worn on a user, and the case 410 includes a display housing 411, a battery case 412, and a body 413.

The display 420 may be disposed on a front surface of the case 410, in the display housing 411, and visualizes an electronic signal to provide visual data to the user. In addition, as an example, the display 420 includes a touch screen panel configured to receive a touch input from a contact object such as a finger or a stylus.

The battery 430 provides power to drive the wearable device. The battery 430 is mounted in the battery case 412, and may be charged by a wireless or wired power charging method.

The driving signal generator 330 (FIG. 3), which is mounted on the main board 450, provides the driving signal to the wireless communication antenna 440 to form the magnetic field. That is, the wireless communication antenna 440, which is the transmitting coil, radiates a magnetic pulse.

In addition, the transmitting coil is magnetically coupled to the wireless signal receiver 210, which includes the receiving coil 211, to thereby wirelessly transmit data. The data may be magnetic stripe data.

Although FIG. 4 illustrates an example in which the wireless communication antenna 440 is mounted to the body 413 between the main board 450 and the battery 430, a mounting position of the wireless communication antenna 440 may be changed.

The wireless communication antenna 440 will be described in more detail with reference to FIGS. 6A through 10.

The strap 460 may be formed of two portions, each of which are to be connected to the body. In addition, in a case in which the strap 460 is formed as a single integral piece, the strap 460 may surround the body 413.

Figure 5:
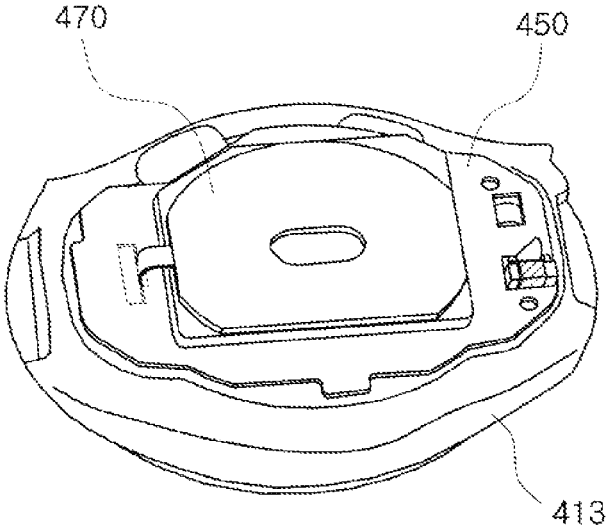
FIG. 5 is a perspective view of an interior of a rear surface of the wearable device of FIG. 4.

FIG. 5 is a perspective view of an interior of a rear surface of the wearable device 400.

Referring to FIGS. 4 and 5, the wearable device 400 includes a wireless power receiving coil 470. As an example, the wireless power receiving coil is disposed between the rear surface of the body 413 and the main board 450.

In addition, the wireless power receiving coil 470 includes a shielding sheet disposed opposite to the rear surface of the body 413, which receives power wirelessly. The shielding sheet may be formed of a magnetic sheet disposed on one surface of the wireless power receiving coil 470, or may be formed by ferrite or a conductive powder applied to the power receiving coil 470.

The shielding sheet is included to efficiently form a magnetic path of the wireless power and to significantly reduce an influence of the magnetic field on the battery 430. However, the shielding sheet may reduce a radiation range of the magnetic field formed by the wireless communication antenna 440. Therefore, in the case of the wearable device 400 adopting such shielding sheet, the wireless communication antenna 440 may include a solenoid coil, which may have a radiation direction on a side of the wireless communication antenna 440 and a side of the wearable device 400, and may have advantageous radiation characteristics in comparison to radiation characteristics of a spiral coil.

Figure 6A:
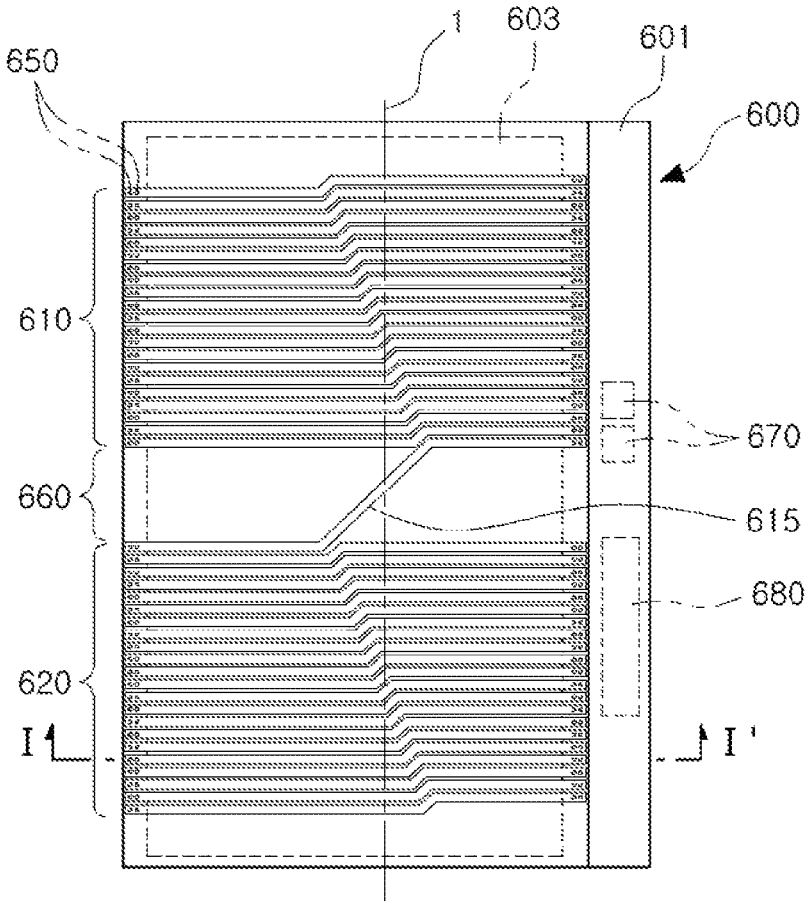
FIG. 6A is a front view of a wireless communication antenna, according to an example.
Figure 6B:
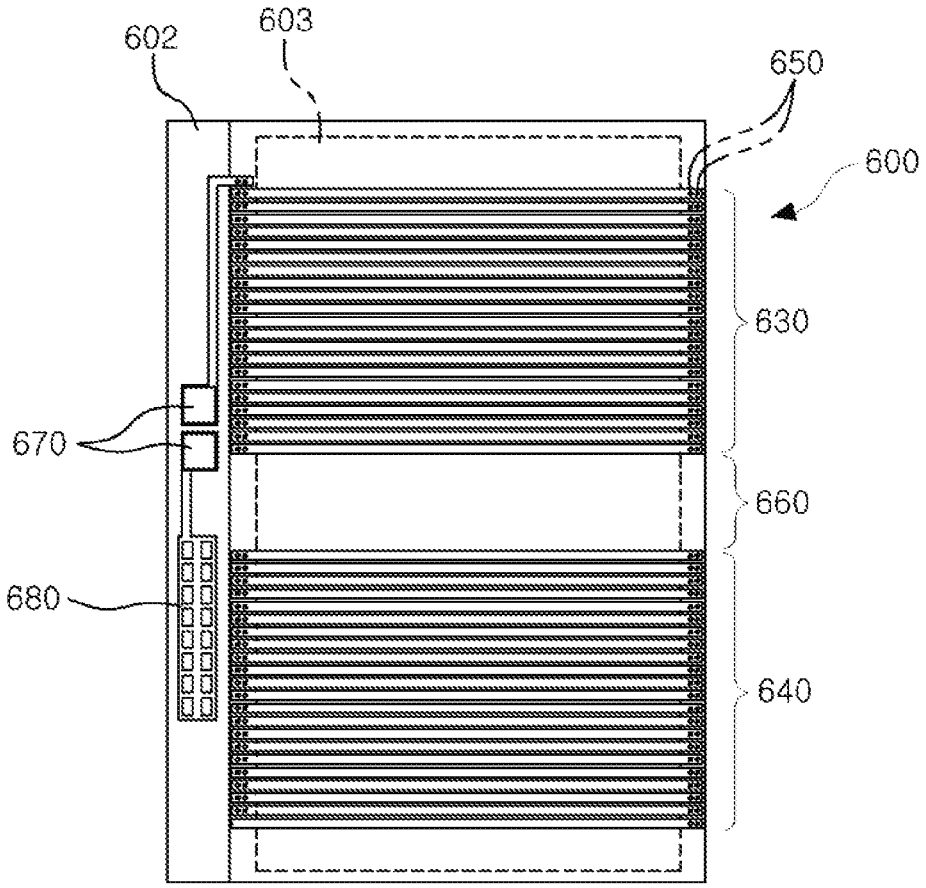
FIG. 6B is a rear view of the wireless communication antenna of FIG. 6A.
Figure 6C:
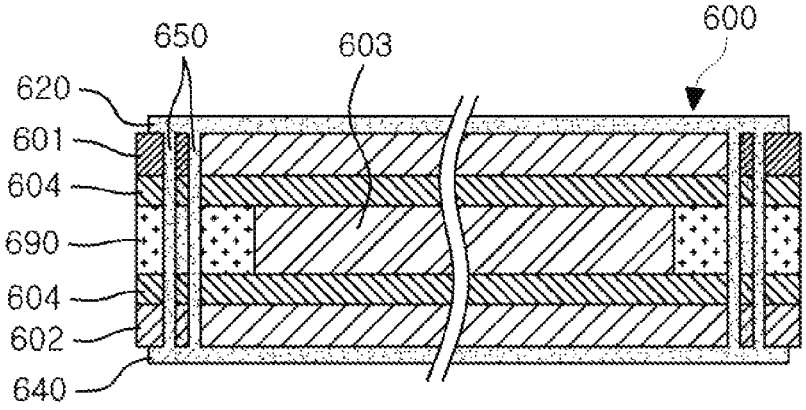
FIG. 6C is a cross-sectional view taken along the line I-I' of FIG. 6A.

FIG. 6A is a front view of a wireless communication antenna 600, according to an example. FIG. 6B is a rear view of the wireless communication antenna 600. FIG. 6C is a cross-sectional view taken along the line I-I' of FIG. 6A.

Referring to FIGS. 6A and 6B, the wireless communication antenna 600 includes a first substrate 601, a second substrate 602, and a magnetic body 603.

Referring to FIG. 6A, the first substrate 601 includes a first wiring part 610 and a second wiring part 620, and is disposed on a first surface of the magnetic body 603, with a space 660 disposed between the first wiring part 610 and the second wiring part 620. In another example, the first wiring part 610 and the second wiring part 620 are formed as one wiring part without having the space 660 disposed therebetween.

Referring to FIG. 6B, the second substrate 602 includes a third wiring part 630 and a fourth wiring part 640, and is disposed on a second surface of the magnetic body 603, with a space 660 disposed between the third wiring part 630 and the fourth wiring part 640. In another example, the third wiring part 630 and the fourth wiring part 640 are formed as one wiring part without having the space 660 disposed therebetween.

The first and second substrates 601 and 602, which are thin film substrates, are, for example, constructed of a flexible board such as a flexible printed circuit board (FPCB). However, the first and second substrates 601 and 602 are not limited to such an example.

In addition, the wireless communication antenna 600 includes conductive vias 650 connecting the first substrate 601 and the second substrate 602 to each other in a region around the magnetic body 603.

As illustrated in FIGS. 6A and 6B, the first to fourth wiring parts 610, 620, 630, and 640 include conductive patterns. The conductive patterns may each configure a portion of one turn of a solenoid coil. For example, one conductive pattern of the first wiring part 610 is connected to one conductive pattern of the third wiring part 630 through a conductive via 650, and one turn of the solenoid coil may be completed by the connection between the one conductive pattern of the first wiring part 610 and the one conductive pattern of the third winding part 630. As such, the first wiring part 610 and the third wiring part 630 are connected to each other by the conductive vias 650 to form a first coil part of the solenoid coil.

In addition, the second wiring part 620 and the fourth wiring part 640 are connected to each other by the conductive vias 650, in a similar manner to that described above with respect to the first wiring part 610 and the third wiring part 630, to form a second coil part of the solenoid coil.

In addition, the first coil part and the second coil part are spaced apart from each other while having a region disposed between the first coil part and the second coil part, wherein the region does not have the conductive pattern formed therein. That is, the space 660 is disposed between the first coil part and the second coil part. In addition, the first and second coil parts connected in series with each other by a connecting member 615 that connects the first wiring part 610 and the second wiring part 620 to each other.

Since the thin film coil formed by the first coil part and the second coil part is not a coil constructed of a type of wire that is used in the related art, and uses coil patterns formed on thin film substrates, the thin film coil may be formed to be very thin. That is, the thin film coil may have a small thickness in a direction transverse to the mounting surfaces of the first and second substrates 601 and 602.

In addition, since the first coil part and the second coil part form two solenoid coil parts which are wound in the same direction, magnetic flux passing through the magnetic body 603 is reinforced.

The magnetic body 603 may be formed by stacking magnetic layers of a thin plate. The magnetic body 603 forms a core of the first and second coil parts, and may prevent an eddy current and reinforce a magnetic field formed by the first and second coil parts. A material and a structure of the magnetic body 603 will be described in more detail with reference to FIGS. 7A through 9.

The wireless communication antenna includes a contact terminal 670 and a filter circuit 680. The contact terminal 670 is a structure for electrically connecting the main board 450 (FIG. 4) to the solenoid coil formed by the first coil part and the second coil part. The wireless communication antenna 600 receives the driving signal through the contact terminal 670. The filter circuit 680 may remove noise from the driving signal or may convert the driving signal to a form suitable for driving the wireless communication antenna 600.

Referring to FIG. 6C, the wireless communication antenna 600 includes the first substrate 601 including the second wiring part 620 formed in the conductive pattern, and the second substrate 602 including the fourth wiring part 640 formed in the conductive pattern, and includes the magnetic body 603 disposed between the first substrate 601 and the second substrate 602. That is, the second wiring part 620 is disposed on a top surface of the magnetic body 603, and the fourth wiring part 640 is disposed on a bottom surface of the magnetic body 603. Similarly, although not shown in FIG. 6C, the first wiring part 610 is disposed on the top surface of the magnetic body 603 and the third wiring part 630 is disposed on the bottom surface of the magnetic body 603.

That is, assuming that the magnetic body 603 is a single substrate, the wireless communication antenna has the conductive patterns formed on the top surface and the bottom surface of the substrate of the magnetic body 603, and includes the conductive vias connecting the conductive pattern formed on the top surface and the conductive pattern formed on the bottom surface to each other.

The first substrate 601 and the second substrate 602 are attached to the magnetic body 603 by adhesive sheets 604. The adhesive sheets 604 may be formed of an adhesive tape, and may also be formed by applying an adhesive or a resin having adhesive properties to a surface of the first and second substrates 601 and 602 or the magnetic body 603.

The conductive vias 650 connect the second wiring part 620 and the fourth wiring part 640 to each other to thereby form the first coil part having a solenoid shape surrounding the magnetic body 603. Similarly, although not shown in FIG. 6C, the conductive vias 650 connect the first wiring part 610 and the third wiring part 630 to each other to thereby form the second coil part having a solenoid shape surrounding the magnetic body 603. The first coil part and the second coil part combine to form the solenoid coil.

As illustrated in FIG. 6C, one conductive pattern on the first substrate 601 and one conductive pattern on the second substrate 602 are connected to each other by two conductive vias 650 to thereby prevent a short-circuit between the conductive patterns.

In addition, the wireless communication antenna 600 includes a resin layer 690. The resin layer 690 may be formed of a thermosetting resin having insulating and adhesive properties. The resin layer 690 is disposed in an empty space, between the first substrate 601 and the second substrate 602, around the magnetic body 603. Since the resin layer 690 supports the first substrate 601 and the second substrate 602in the empty space around the magnetic body 603, the resin layer 690 may prevent faults such as short-circuits or bubble introduction, which may occur during a process. In addition, the conductive via 650 penetrates through the resin layer 690.

Figure 7A:
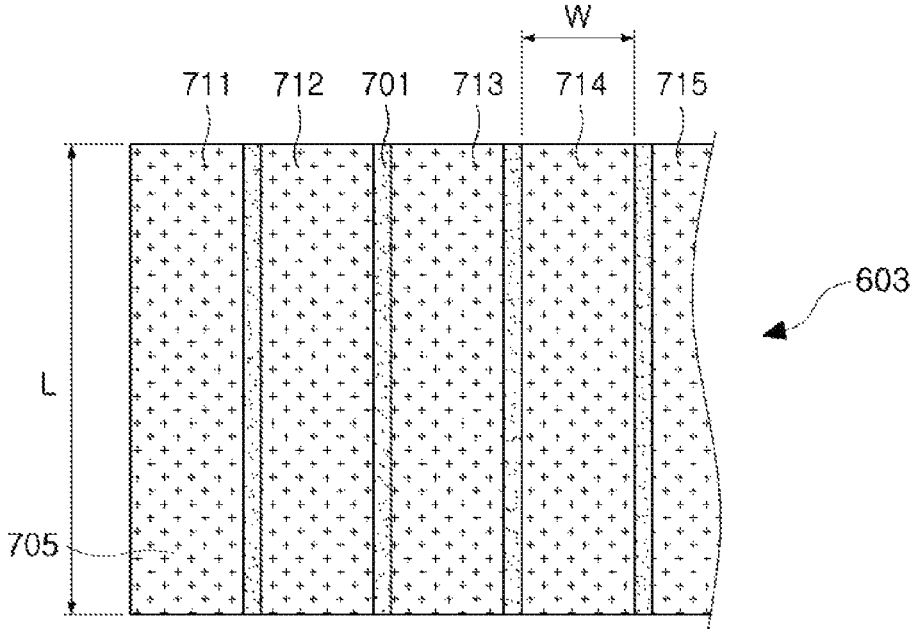
FIG. 7A is a front view illustrating a magnetic body included in the wireless communication antenna of FIG. 6A, according to an example.
Figure 7B:
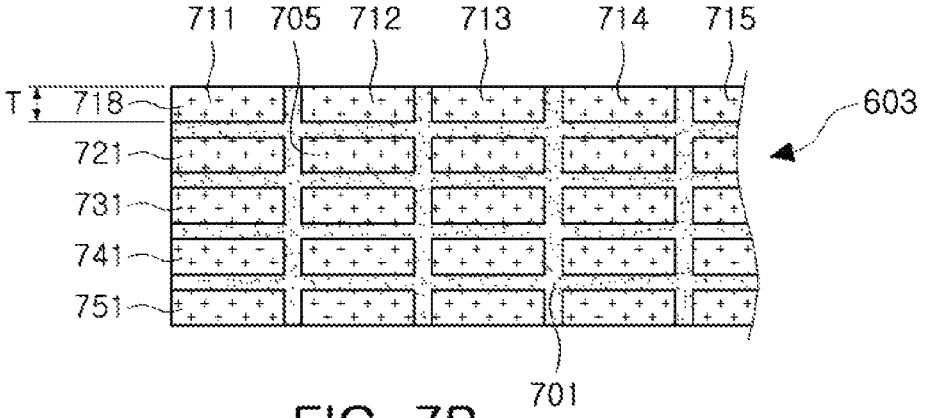
FIG. 7B is a cross-sectional view of the magnetic body illustrated in FIG. 7A.

FIG. 7A is a front view illustrating the magnetic body 603 included in the wireless communication antenna 600 (FIG. 6A). FIG. 7B is a cross-sectional view of the magnetic body 603. Referring to FIG. 7A, the magnetic body 603 includes unit ribbons 705 having a bar shape and arranged in columns 711 to 715.

Since the unit ribbons 705 have a bar shape, they have shape anisotropy such that they are easily magnetized in a direction parallel to a length direction L. For instance, in a case in which a polycrystal sample which does not have a preferred orientation has a spherical shape, the sample is magnetized in all directions in the same range. However, in a case in which a polycrystal sample which does not have a preferred orientation does not have a spherical shape, the sample is easily magnetized on a long axis of the sample, as compared to a short axis of the shape. This characteristic is due to a strong demagnetization field being formed along the short axis. That is, the shape of the unit ribbons 705 is a factor of magnetic anisotropy, and the unit ribbons 705 have shape anisotropy reinforcing the magnetic field in the length direction L.

In addition, referring to FIG. 7B, the unit ribbons 705 are arranged on a single plane in the columns 711 to 715 form a magnetic layer 718. The magnetic body is formed, for example, by stacking the first magnetic layer 718 and magnetic layers 721, 731, 741 and 751.

A thickness T of each of the unit ribbons 705 may be in a range of 10 μm to 200 μm, and a width W of each of the unit ribbons 705 may be 40 mm or less.

In addition, the unit ribbons 705 may have an aspect ratio (W:L) of 1:6 to 1:9. The aspect ratio of the unit ribbons 705 will be described in more detail with reference to FIG. 12.

Although FIG. 7B illustrates a case in which five magnetic layers 718, 721, 731, 741 and 751 are stacked, the number of stacked magnetic layers may be varied. In addition, the length direction L of the unit ribbons are disposed parallel to an axis direction 1 (FIG. 6A) of the solenoid coil.

The wireless communication antenna 600 reinforces the magnetic field formed by the solenoid coil using the magnetic body 603 having an arrangement of the unit ribbons 705. In addition, the thin film solenoid coil having the magnetic body 603 as the core is mounted in a wearable device to thereby have the radiation direction in the side of the wireless communication antenna 600 and on a side of a wearable device, such as the wearable device 400 (FIG. 4).

The unit ribbons 705 may be formed by pressing a magnetic powder material or pressing and then sintering the magnetic powder material. The unit ribbons 705 may be metal ribbons of a thin plate having an amorphous structure or a nanocrystal structure. Alternatively, the unit ribbons 705 may be formed of permalloy, which is a high permeability material.

An iron (Fe)-based magnetic alloy or a cobalt (Co)-based magnetic alloy may be used as the alloy having the amorphous structure. For example, an Fe—Si—B alloy may be used as the Fe-based magnetic alloy. As content of a metal including Fe is high, saturation magnetic flux density is increased. However, when the content of an Fe element is excessive, it is difficult to form the amorphous structure. Therefore, the content of Fe may be 70 to 90 atomic %, and, when a summation of Si and B is 10 to 30 atomic %, the alloy may have the best amorphous formation ability. In order to prevent corrosion, corrosion resistant elements such as Cr, Co, and the like may be added within 20 atomic % to the above-mentioned basic composition, and a small quantity of other metal elements may be included to give other characteristics, as needed.

An Fe-based nano crystal grain magnetic alloy may be used as the metal ribbon having a nanocrystal structure. As the Fe-based nano crystal grain alloy, a Fe—Si—B—Cu—Nb alloy may be used.

An adhesive layer 701 for an interlayer bonding of the magnetic layers 718, 721, 731, 741 and 751 is disposed between the magnetic layers 718, 721, 731, 741 and 751. The adhesive layer 701 may be formed by applying an adhesive sheet, an adhesive, or a resin having adhesive property.

Alternatively, the adhesive layer 701 may be chemically coupled to a material forming the magnetic layers 718, 721, 731, 741 and 751. As an example, the adhesive layer 701 may be formed of a material including oragnosilane. In addition, the adhesive layer 701 is filled between the unit ribbons 705 forming a magnetic layer.

The unit ribbons 705 have relatively high permeability, and the adhesive layer has relatively low permeability. In this case, the magnetic field passing through the magnetic body 603 is reinforced in the length direction L in each of the unit ribbons 705.

Figure 8A:
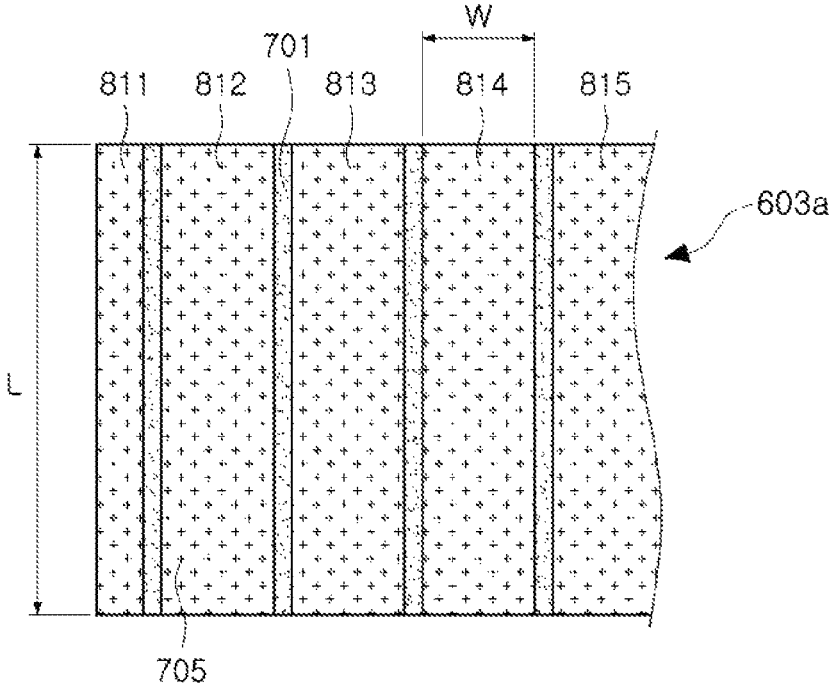
FIG. 8A is a front view illustrating a magnetic body included in a wireless communication antenna, according to another example.
Figure 8B:
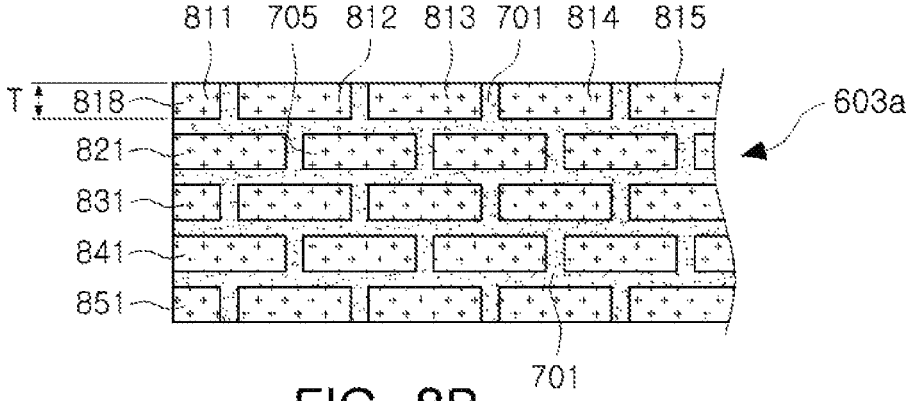
FIG. 8B is a cross-sectional view of the magnetic body illustrated in FIG. 8A.

FIG. 8A is a plan view illustrating a magnetic body 603*a* included in a wireless communication antenna. FIG. 8B is a cross-sectional view of the magnetic body 603*a*.

Referring to FIGS. 8A and 8B, the magnetic body 603*a* is includes unit ribbons 705 arranged in columns 811 to 815, as in the magnetic body described with reference to FIG. 7A and 7B. The unit ribbons 705 are stacked in layers 818, 821, 831, 841 and 851.

A thickness T of each of the unit ribbons 705 may be in a range of 10 μm to 200 μm, and a width W of each of the unit ribbons 705, except for the outermost unit ribbon 705, may be 40 mm or less.

The unit ribbons 705 are arranged so that a boundary between the unit ribbons 705 of one magnetic layer, among the magnetic layers 818, 821, 831, 841 and 851, does not overlap with a boundary between the unit ribbons of a magnetic layer, among the magnetic layers 818, 821, 831, 841 and 851, that is adjacent to the one magnetic layer. That is, the boundaries between the unit ribbons 705 formed on a top surface and a bottom surface in relation to a surface at which the magnetic layers 818, 821, 831, 841 and 851 are bonded may be arranged to intersect with each other. In other words, the columns 811 to 815, and therefore the unit ribbons 705, in a magnetic layer are offset from the columns 811 to 815, and therefore the unit ribbons 705, in an adjacent magnetic layer. Due to the described structure of the magnetic body 603*a*, permeability may be improved, and loss of an eddy current may be reduced.

Since the material and the structure of the magnetic body 603*a* can be understood from the magnetic body 603 described with reference to FIGS. 7A and 7B, a further description of the magnetic body 603*a* will be omitted.

Figure 9:
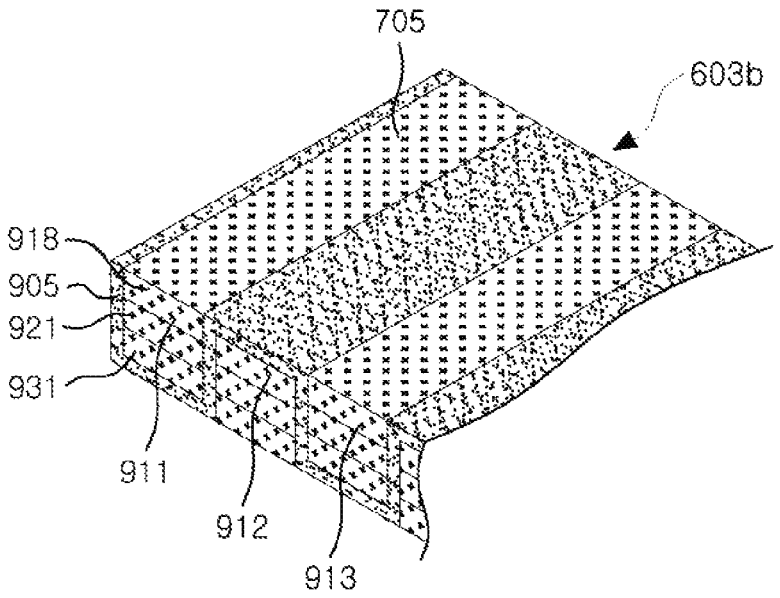
FIG. 9 is a perspective view illustrating a magnetic body included in a wireless communication antenna, according to another example.

FIG. 9 is a perspective view illustrating a magnetic body 603*b* included in a wireless communication antenna, according to another example. Referring to FIG. 9, the magnetic body 603*b* includes stacked magnetics layers 918, 921 and 931 in which unit ribbons 705 are arranged in columns 911 to 913.

In addition, the magnetic body 603*b* includes a structural wall 905 separating the columns 911 to 913. As illustrated in FIG. 9, the structural wall 905 may be formed of one continuous thin film surrounding a side surface, and a top surface or a bottom surface of each of the columns 911 to 913.

The structural wall 905 may be formed of the same material as that of the unit ribbons 705, or may be formed of a different magnetic or non-magnetic material. Alternatively, the structural wall 905 may be a film formed of a resin material and a material including magnetic powder in the resin. In addition, the structural wall 905 may have an insulation property.

Meanwhile, the structural wall 905 may be attached to the unit ribbons 705 through adhesive properties on one surface or both surfaces of the structural wall 905 to thereby serve to support the unit ribbons 705. To this end, the structural wall 905 may be a film on which an adhesive is applied, or may be an adhesive tape.

Since the magnetic body adopting the structural wall 905 may omit the adhesive layer 701 (FIGS. 7A and 7B) between the magnetic layers 918, 921 and 931, a wireless communication antenna having a small thickness may be implemented. Alternatively, a larger number of magnetic layers may be stacked in a given thickness.

In addition, by adopting the structural wall 905, directivity of the magnetic flux passing through the unit ribbons 705 may be improved, and radiation characteristics of anisotropy of the wireless communication antenna may be improved.

Since the material and the structure of the magnetic body 603*b* can be understood from description of the magnetic body 603 described with reference to FIGS. 7A and 7B, a further description of the magnetic body 603*b* will be omitted.

Figure 10:
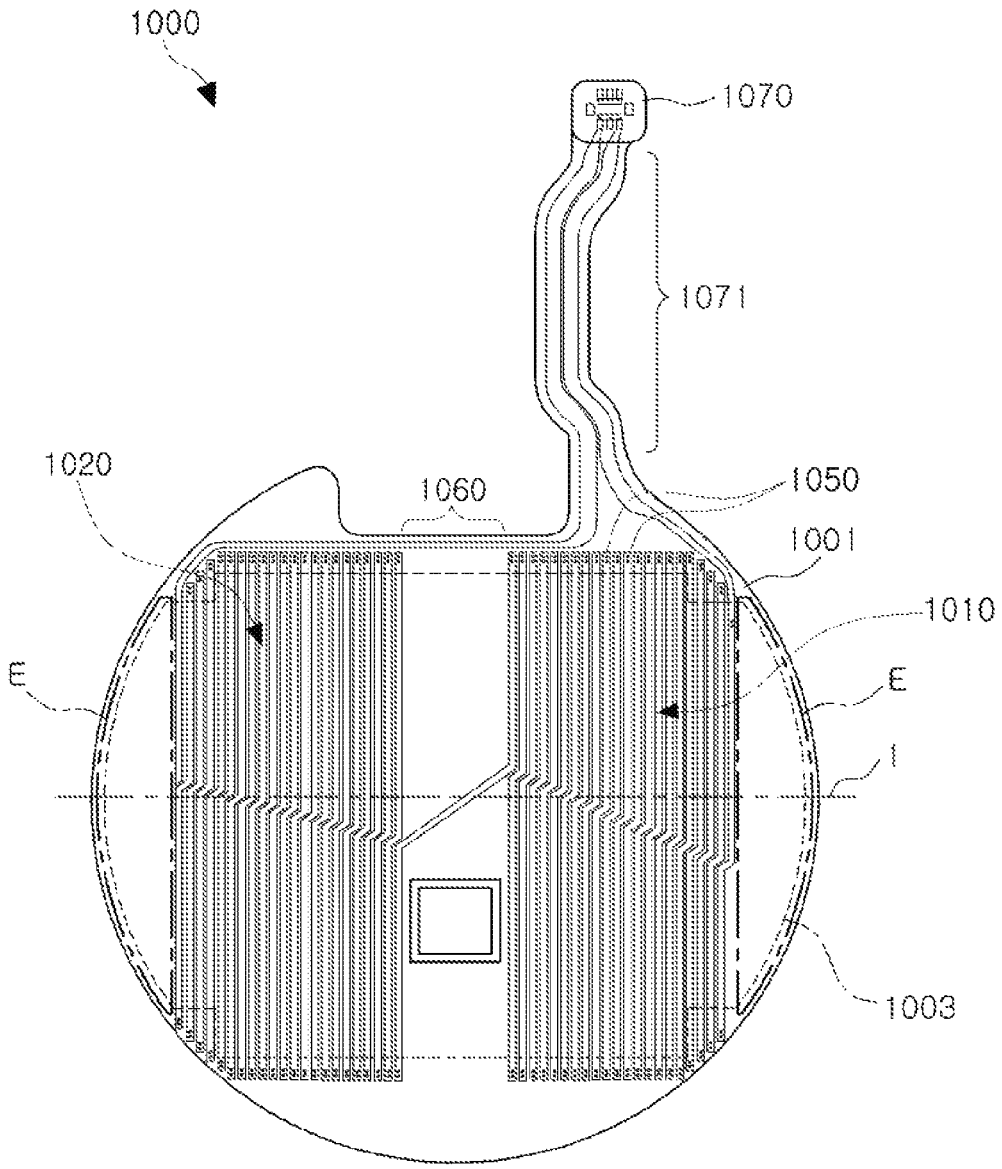
FIGS. 10 and 11 illustrate various wireless communication antennas, according to other examples.
Figure 11:
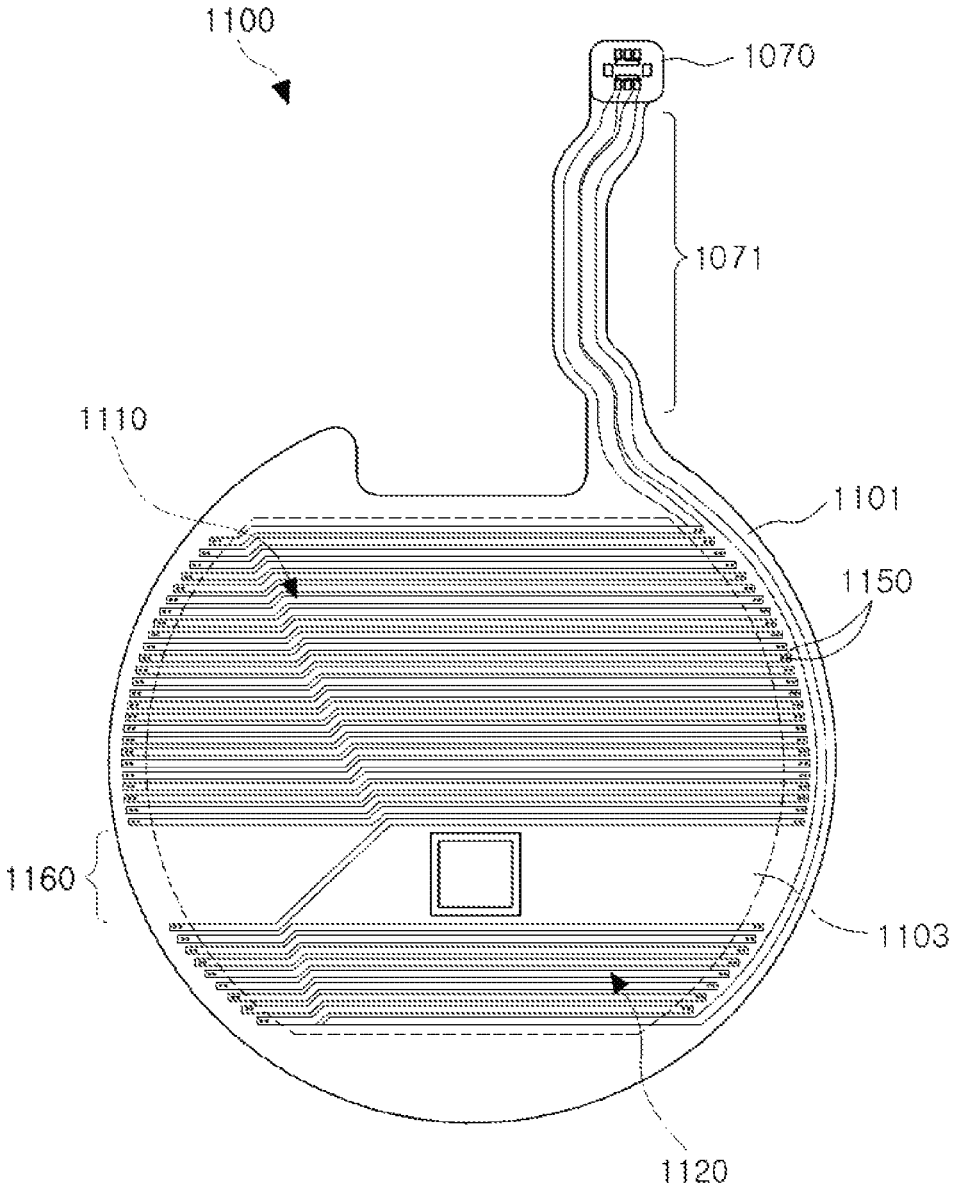

FIGS. 10 and 11 are views illustrating wireless communication antennas 1000 and 1100, according to additional examples. Although FIGS. 10 and 11 are front views illustrating front surfaces of the wireless communication antennas 1000 and 1100, the following description may be equally applied to rear surfaces of the wireless communication antennas 1000 and 1100. In addition, the wireless communication antennas 1000 and 1100 described with reference to FIGS. 10 and 11 are not exclusive of the example of the wireless communication antenna 600 of FIGS. 6A through 9. Therefore, a description overlapping that of the wireless communication antenna described above will be omitted.

Referring to FIG. 10, a first substrate 1001 of the wireless communication antenna 1000 has a shape that enables the wireless communication antenna 1000 to be easily mounted in a wearable device. For example, the first substrate 1001 has a circular shape, an oval shape, or a polygonal shape, and may have at least depressed or protruding portion. In addition, a contact terminal 1070 for electrically connecting a solenoid coil and the main board 450 (FIG. 4) to each other is disposed at one end of a lead part 1071 protruding from the first substrate 1001. The solenoid coil includes first and second coil parts, which respectively include first and second wiring parts 1010 and 1020 disposed on the first substrate 1001 with a space 1060 therebetween.

A magnetic body 1003 serving as a core of the solenoid coil includes protruding parts E extending from both ends of the solenoid coil. The magnetic body 1003 may extend to an edge of the first substrate 1001. In an example, the protruding parts E extend to an edge of the first substrate 1001.

Conductive vias 1050 are formed along a region adjacent to the edge of the first substrate 1001 outside of the magnetic body 1003.

A shape of the magnetic body 1003 may be variously modified depending on a shape of the substrate 1001, or a length and an arrangement of the conductive patterns of the first and second wiring parts 1010 and 1020. That is, the magnetic body 1003 may have a circular shape, an oval shape, or a polygonal shape, and may have at least a depressed or protruding portion. A radiation direction and a radiation range of the magnetic field radiated by the solenoid coil may be adjusted by varying the shape of the magnetic body 1003.

Referring to FIG. 11, the wireless communication antenna 1100 includes a solenoid coil including first and second coil parts, which respectively include first and second wiring parts 1110 and 1120 disposed on a first substrate 1101. The wireless communication antenna 1100 further includes a magnetic body 1103 serving as the core of the solenoid coil. The first and second wiring parts 1110 and 1120 include conductive patterns having various lengths depending on a shape of the first substrate 1101.

For example, as illustrated in FIG. 11, the conductive patterns are formed in a shape in which patterns of increased and decreased lengths are arranged to form chords of a circle.

In addition, the magnetic body 1103 may extend to an edge of the first substrate 1101. Conductive vias 1150 are formed along a region adjacent to the edge of the first substrate 1101 outside of the magnetic body 1103.

In addition, the first and second wiring parts 1110 and 1120 (and, thus, the first and second coil parts) may have a different number of conductive patterns, and a layout of a space 1160 between the first and second wiring parts 1110 and 1120 may be changed. For example, as illustrated in FIG. 11, in a case in which a position of the space 1160 is biased toward the second wiring part 1120, the number of conductive patterns included in the second wiring part 1120 may be smaller than the number of conductive patterns included in the first wiring part 1110. In addition, in a case in which the position of the space 1160 is biased toward the second wiring part 1120, a width or an arrangement interval of the conductive patterns included in the second wiring part 1120 may be smaller than the width or the arrangement interval of the conductive patterns included in the first wiring part 1110.

Figure 12:
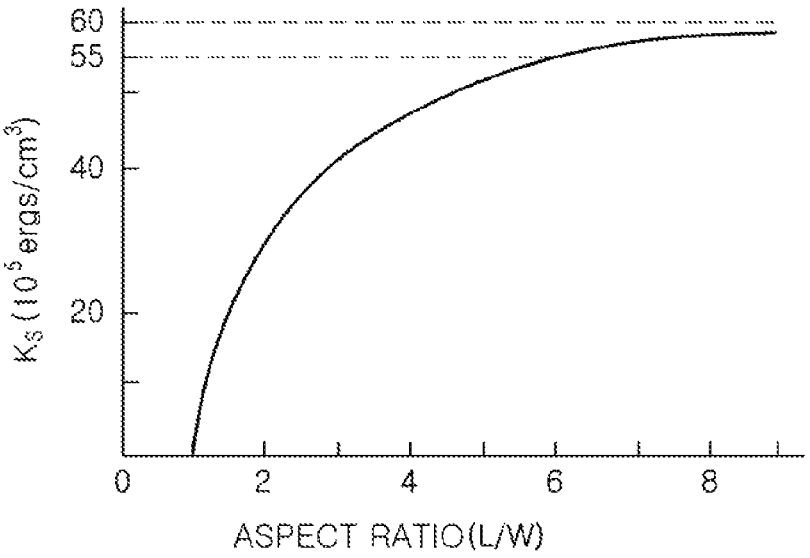
FIG. 12 is a graph illustrating a relationship between a shape anisotropic constant and aspect ratio, in a metal ribbon.

FIG. 12 is a graph illustrating a relationship between a shape anisotropic constant and aspect ratio, in a metal ribbon. The graph illustrates an experiment result of a Co-based magnetic alloy having magnetic saturation of the metal ribbon of 1422 (emu/cm$^3$). In FIG. 12, the aspect ratio is indicated by a ratio (L/W) of a length L of the metal ribbon to a width W of the metal ribbon.

Referring to FIG. 12, it can be seen that, when the aspect ratio (W:L) is 1:6 or more, a shape anisotropic constant Ks reaches 55($10^5$ ergs/cm$^3$). In addition, when the aspect ratio is 1:9, the shape anisotropic constant Ks reaches a saturation value. Therefore, in order to have an appropriate shape anisotropic constant Ks, the unit ribbons may have an aspect ratio of 1:6 to 1:9.

As set forth above, a wireless communication antenna includes a miniaturized and thinned solenoid coil, and has improved radiation characteristics.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A wireless communication antenna, comprising:

a magnetic body comprising a magnetic layer, the magnetic layer including a plurality of bar-shaped unit ribbons arranged in columns in a same plane, the plurality of unit ribbons having shape anisotropy and a radiation direction on a side of the wireless communication antenna; and a solenoid coil comprising conductive patterns disposed around the magnetic body, wherein the magnetic body further comprises a wall separating the columns.

2. The wireless communication antenna of claim 1, wherein a length direction of the plurality of unit ribbons is parallel to an axis direction of the solenoid coil.

3. The wireless communication antenna of claim 1, wherein the plurality of unit ribbons are further arranged in stacked magnetic layers.

4. A wireless communication antenna, comprising:

a magnetic body comprising a plurality of bar-shaped unit ribbons arranged in columns, the unit ribbons having shape anisotropy and a radiation direction on a side of the wireless communication antenna; and a solenoid coil comprising conductive patterns disposed around the magnetic body, wherein the plurality of unit ribbons is further arranged in stacked magnetic layers, and wherein the plurality of unit ribbons are arranged such that a first boundary between unit ribbons, among the plurality of unit ribbons, of one magnetic layer, among the stacked magnetic layers, does not overlap a second boundary between unit ribbons, among the plurality of unit ribbons, of another magnetic layer, among the stacked magnetic layers, the another magnetic layer being adjacent to the one magnetic layer.

5. The wireless communication antenna of claim 1, wherein the wall comprises a continuous film surrounding a side surface of each of the columns and one of a top surface and a bottom surface of each of the columns.

6. The wireless communication antenna of claim 5, wherein the wall comprises a material having magnetic properties.

7. The wireless communication antenna of claim 1, wherein the plurality of unit ribbons comprise one of a nanocrystal alloy, an amorphous crystal alloy, or permalloy.

8. The wireless communication antenna of claim 1, wherein each unit ribbon among the plurality of unit ribbons comprises a thickness of 10 μm to 200 μm.

9. The wireless communication antenna of claim 1, wherein each unit ribbon among the plurality of unit ribbons comprises a width of 40 mm or less.

10. The wireless communication antenna of claim 1, wherein the magnetic body comprises a shape that is outwardly convex in an axis direction of the solenoid coil.

11. The wireless communication antenna of claim 1, further comprising;

a resin layer disposed around the magnetic body.

* * * * *